US011499402B2

(12) United States Patent
Crowley et al.

(10) Patent No.: US 11,499,402 B2
(45) Date of Patent: Nov. 15, 2022

(54) SYSTEM AND METHODOLOGY USING LOCKING SEALING MECHANISM

(71) Applicant: Schlumberger Technology Corporation, Sugar Land, TX (US)

(72) Inventors: Matthew Thomas Crowley, Houston, TX (US); James Rudolph Wetzel, Rosharon, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 16/305,791

(22) PCT Filed: May 16, 2017

(86) PCT No.: PCT/US2017/032872
§ 371 (c)(1),
(2) Date: Nov. 29, 2018

(87) PCT Pub. No.: WO2017/209941
PCT Pub. Date: Dec. 7, 2017

(65) Prior Publication Data

US 2020/0325744 A1 Oct. 15, 2020

Related U.S. Application Data

(60) Provisional application No. 62/343,118, filed on May 30, 2016.

(51) Int. Cl.
*E21B 23/01* (2006.01)
*E21B 43/12* (2006.01)

(52) U.S. Cl.
CPC ..... *E21B 43/128* (2013.01); *E21B 23/01* (2013.01)

(58) Field of Classification Search
CPC ..... E21B 43/128; E21B 23/01
See application file for complete search history.

(56) References Cited

U.S. PATENT DOCUMENTS 4,211,440 A * 7/1980 Bergstrom ..... B23K 20/085 138/147
4,433,725 A 2/1984 Bowyer
(Continued)

FOREIGN PATENT DOCUMENTS

WO 0240822 A1 5/2002

OTHER PUBLICATIONS

Search Report and Written Opinion of International Patent Application No. PCT/US2017/032872 dated Aug. 28, 2017, 16 pages.
(Continued)

*Primary Examiner* — D. Andrews

(57) ABSTRACT

A technique facilitates deployment and operation of a pumping system, e.g. an electric submersible pumping system, in a borehole. A locking and sealing mechanism, e.g. a spring-loaded locking sealing mechanism, may be coupled with the pumping system and comprises an anchoring section along with a sealing section. The locking sealing mechanism may be constructed for deployment with the pumping system via a running tool. Once in position downhole, the anchoring section and the sealing section may be actuated into sealing engagement with the interior surface of a surrounding tubing. At this stage, production of a desired fluid may be accomplished by operating the pumping system.

18 Claims, 4 Drawing Sheets

(56) References Cited

U.S. PATENT DOCUMENTS

| | | | | |
|---|---|---|---|---|
| 4,457,369 | A * | 7/1984 | Henderson | E21B 33/1293 166/125 |
| 2009/0139730 | A1 | 6/2009 | Olson et al. | |
| 2009/0202371 | A1 | 8/2009 | Green | |
| 2010/0206577 | A1* | 8/2010 | Martinez | E21B 23/14 166/369 |
| 2011/0036576 | A1 | 2/2011 | Schultz et al. | |
| 2012/0298901 | A1* | 11/2012 | Ringgenberg | E21B 34/06 251/313 |
| 2013/0340245 | A1* | 12/2013 | Watson | F04D 13/10 29/592.1 |
| 2018/0363431 | A1 | 12/2018 | Crowley et al. | |

OTHER PUBLICATIONS

International Preliminary Report on Patentability of International Patent Application No. PCT/US2017/032872 , dated Dec. 13, 2018, 12 pages.

* cited by examiner

SYSTEM AND METHODOLOGY USING LOCKING SEALING MECHANISM

CROSS-REFERENCE TO RELATED APPLICATION

The present document is based on and claims priority to U.S. Provisional Application Ser. No. 62/343,118, filed May 30, 2016, which is incorporated herein by reference in its entirety.

BACKGROUND

Following discovery of a desired subterranean resource, e.g. oil, natural gas, or other desired subterranean resources, well drilling and production systems often are employed to access and extract the resource or resources. For example, a wellbore may be drilled into a hydrocarbon bearing reservoir and then a pumping system may be deployed downhole. The pumping system is operated to pump oil and/or other fluids to the surface for collection. The pumping system may comprise an electric submersible pumping system having a submersible centrifugal pump powered by a submersible electric motor.

SUMMARY

In general, the present disclosure provides a system and methodology for deploying a pumping system, e.g. an electric submersible pumping system, into a borehole. A locking and sealing mechanism, e.g. a spring-loaded locking sealing mechanism, may be coupled with the pumping system and comprises an anchoring section along with a sealing section. The locking sealing mechanism is constructed for deployment with the pumping system via a running tool. Once in position downhole, the anchoring section and the sealing section may be actuated into sealing engagement with the interior surface of a surrounding tubing. At this stage, production of a desired fluid may be accomplished by operating the pumping system.

BRIEF DESCRIPTION OF THE DRAWINGS

Certain embodiments will hereafter be described with reference to the accompanying drawings, wherein like reference numerals denote like elements. It should be understood, however, that the accompanying figures illustrate various implementations described herein and are not meant to limit the scope of various technologies described herein, and.

DETAILED DESCRIPTION

In the following description, numerous details are set forth to provide an understanding of some illustrative embodiments of the present disclosure. However, it will be understood by those of ordinary skill in the art that the system and/or methodology may be practiced without these details and that numerous variations or modifications from the described embodiments may be possible.

The disclosure herein generally relates to a system and methodology for deploying and operating a pumping system, e.g. an electric submersible pumping system, into a borehole. A locking and sealing mechanism, e.g. a spring-loaded locking sealing mechanism, may be coupled with the pumping system and comprises an anchoring section along with a sealing section. The combined tool string may be constructed for deployment via a running tool which may be released following deployment to a desired position in the borehole. Once in position downhole, the anchoring section and the sealing section may be actuated into sealing engagement with the interior surface of a surrounding tubing. By way of example, the surrounding tubing may comprise well casing or a tubular element of a docking station as explained in greater detail below. At this stage, production of a desired fluid may be accomplished by operating the pumping system.

Figure 1:
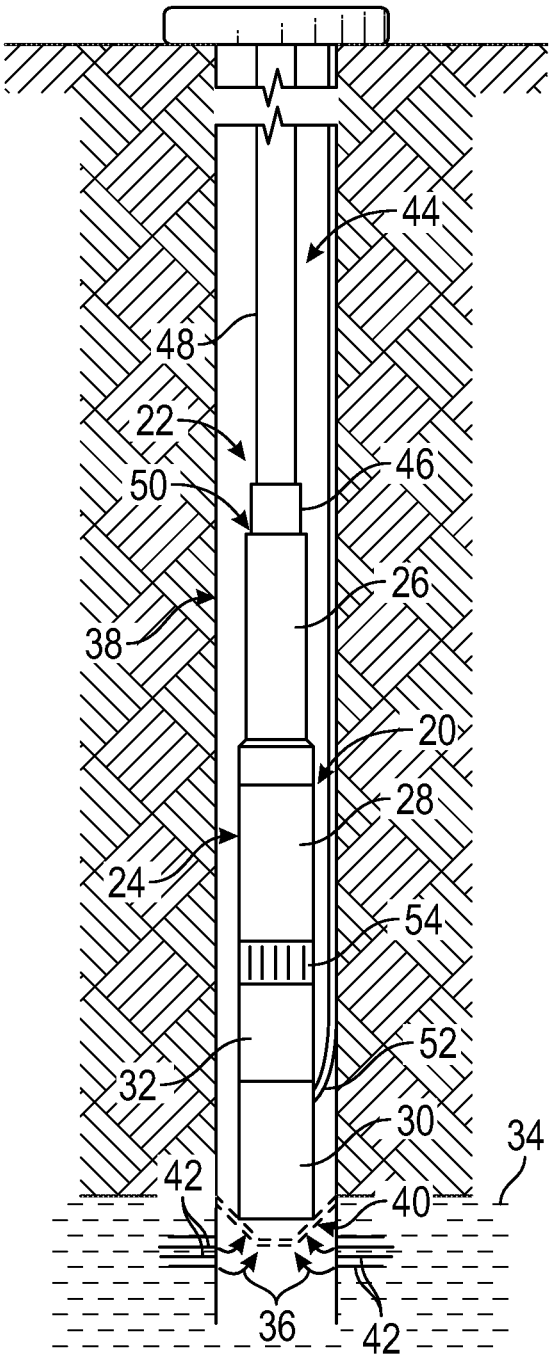
FIG. 1 is a schematic illustration of an example of a well system including an electric submersible pumping system, according to an embodiment of the disclosure.

Referring generally to FIG. 1, an embodiment of a submersible pumping system 20 is illustrated as being deployed downhole into a borehole 22, e.g. a wellbore, for production of desired fluids, e.g. oil. By way of example, the submersible pumping system 20 may comprise or be in the form of an electric submersible pumping system 24. Additionally, the submersible pumping system 20 may comprise a variety of components depending on the particular application or environment in which it is used. For purposes of explanation, the submersible pumping system 20 has been illustrated as combined with a spring-loaded locking sealing mechanism (SLLSM) 26 which is explained in greater detail below. It should be noted SLLSM 26 is very useful in applications utilizing a docking station as discussed below with respect to FIGS. 2-4. However, the SLLSM 26 may be used with other types of applications.

In the embodiment illustrated in FIG. 1, the electric submersible pumping system 24 comprises a submersible pump 28, a submersible electric motor 30, and a motor protector 32. The submersible pump 28 is operatively coupled with the submersible motor 30 by, for example, a driveshaft. Depending on the operation, electric submersible pumping system 24 may comprise other components such as a gauge section, other types of sensors, and various other components selected for a given application. In some embodiments, submersible pump 28 may be a centrifugal pump having two or more stages, e.g. compression stages, with impellers rotated by submersible motor 30.

Borehole 22 may be in the form of a wellbore drilled into a geologic formation 34 containing a desirable production fluid 36, e.g. oil. The electric submersible pumping system 24 may be deployed into a tubing 38, e.g. a well casing, a docking station tubing, or another suitable well tubing. In the embodiment illustrated in FIG. 1, the submersible pumping system 20 is landed on a suitable landing 40 positioned in borehole 22 to facilitate actuation of SLLSM 26. In the embodiment illustrated in FIGS. 2-4, the landing is provided by a docking station but other types of suitable landings 40 may be used for other types of applications. A plurality of perforations 42 may be formed through the tubing/well casing 38 to enable flow of fluids between the surrounding formation 34 and the wellbore 22.

The electric submersible pumping system 24 may be deployed downhole into borehole 22 via a conveyance system 44 comprising, for example, a running tool 46 connected to a conveyance 48. The running tool 46 may be releasably coupled with the SLLSM 26. Depending on the parameters of a given operation, the conveyance 48 may comprise tubing, e.g. coiled tubing. However, the conveyance 48 also may comprise wireline, slick line, or other suitable conveyance mechanisms able to convey the combined pumping system string 50 (having submersible pumping system 20 combined with SLLSM 26) downhole from a surface location 52.

During operation, electrical power may be supplied to submersible motor 30 via a power cable 52. The power cable 52 may be routed to the surface along the inside surface of tubing/casing 38 to facilitate retrieval of running tool 46 and conveyance 48 after landing electric submersible pumping system 24. The submersible motor 30 is electrically powered to, in turn, power submersible pump 28 via a suitable driveshaft. Operation of submersible pump 28 causes fluid 36 (which has flowed into borehole 22) to be drawn into the submersible pumping system 20 through a pump intake 54. The fluid 36 is pumped upwardly to a surface collection location or to another suitable collection location.

Figure 2:
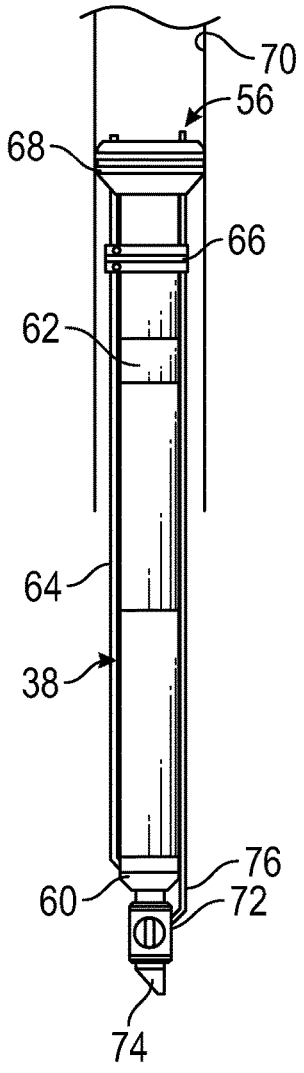
FIG. 2 is an illustration of an example of a docking station combined with production tubing above, the docking station being constructed to receive a pumping system and a spring-loaded locking sealing mechanism, according to an embodiment of the disclosure.
Figure 3:
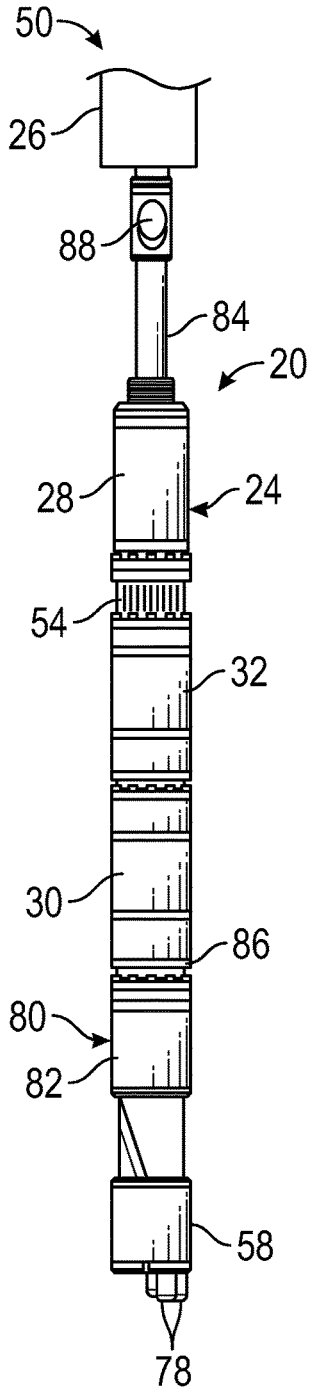
FIG. 3 is an illustration of another example of a well system including an electric submersible pumping system which may be deployed into the docking station, according to an embodiment of the disclosure.
Figure 4:
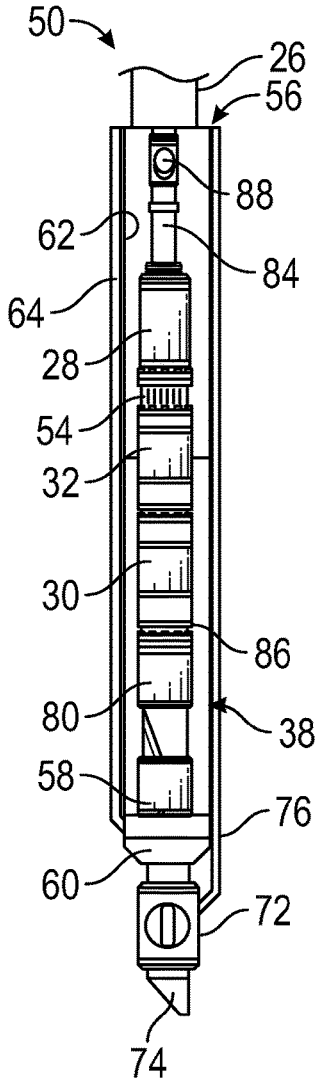
FIG. 4 is an illustration of a well system in which the electric submersible pumping system and a spring-loaded locking sealing mechanism have been deployed in the docking station, according to an embodiment of the disclosure.

Referring generally to FIGS. 2-4, another embodiment of the combined pumping string 50 is illustrated in which the combined electric submersible pumping system 24 and SLLSM 26 are deployed into a docking assembly 56. According to an embodiment, the docking assembly 56 may be constructed to receive electric submersible pumping system 24 and to provide power to electric submersible pumping system 24 via a motor connector 58 (see FIG. 3). In this example, the docking assembly 56 comprises a docking station 60 internally configured for receipt and electrical connection with motor connector 58.

Motor connector 58 may be coupled to submersible motor 30 via a suitable internal conductor or conductors, e.g. three internal wire conductors, to provide power thereto. The docking assembly further comprises tubing 38 in the form of a receiving tubular 62 which is coupled to the docking station 60 and sized to receive the submersible pumping system 20, e.g. electric submersible pumping system 24, and SLLSM 26. The receiving tubular 62 may comprise a single tubular or a plurality of aligned tubulars having internal diameters sufficiently large to receive the electric submersible pumping system 24 and the SLLSM 26 as the motor connector 58 is moved down into electrical engagement with the docking station 60 (see FIG. 4).

Electric power may be provided to docking station 60 via an electrical power cable 64. Electrical power cable 64 may be routed from a surface power source or other suitable power source and deployed downhole with or as part of docking assembly 56. In the illustrated example, the power cable 64 is routed down along the exterior of receiving tubular 62 and into docking station 60. A cable clamp or clamps 66 may be used to secure the power cable 64 along receiving tubular 62.

In some embodiments, the docking assembly 56 may comprise other components, such as a docking station seal assembly 68, e.g. a tubing hanger, constructed to seal against a surrounding surface, e.g. against a well casing 70. In some applications, the seal assembly 68 may be in the form of a packer selectively expandable against the surrounding casing 70. In the illustrated example, the docking station seal assembly 68 is connected to receiving tubular 62.

As further illustrated in FIG. 2, the docking assembly 56 also may comprise other components, such as a valve 72 coupled between a fluid intake 74 and the docking station 60. Fluid intake 74 allows fluid from the borehole 22 to enter into the interior of docking assembly 56 for pumping by, for example, the electric submersible pumping system 24 located inside. The valve 72 may be provided to enable selective closure of this flow path into docking assembly 56. In some embodiments, valve 72 may be controlled via a control line 76, e.g. a hydraulic control line, pneumatic control line or electrical control, selected according to the valve type.

With additional reference to FIG. 3, an embodiment of the combined well string 50 is further illustrated. In this embodiment, the electric submersible pumping system 24 and SLLSM 26 are sized for receipt in docking assembly 56. The electric submersible pumping system 24 may comprise submersible pump 28, submersible motor 30, motor protector 32, and motor connector 58 as with the embodiment illustrated in FIG. 1. The motor connector 58 comprises at least one electrical connector 78, e.g. a plurality of electrical connectors 78, positioned for engagement with at least one corresponding electrical wet connector, e.g. a plurality of corresponding electrical wet connectors, in docking station 60.

In some embodiments, submersible motor 30 is powered by three-phase electrical power and three electrical connectors 78 are conductively coupled with motor 30 via suitable internal conductors for supplying the three-phase power to submersible motor 30. The motor connector 58 may be positioned at a lower end of the electric submersible pumping system 24 to facilitate engagement with docking station 60. Once the motor connector 58 is electrically engaged with docking station 60, electrical power can be provided to submersible motor 30 via electricity supplied to docking station 60 by power cable 64.

Depending on the application, the electric submersible pumping system 24 may comprise other components, such as a gauge section 80 having sensors 82. The electric submersible pumping system 24 also may comprise features such as an expansion joint 84, a swivel 86, a bypass valve 88, and/or other components to facilitate a given operation. The swivel 86 may be used for aiding alignment of motor connector 58 with docking station 60 (see FIG. 4) without turning the entire electric submersible pumping system 24 or the combined string 50. The swivel 86 may be located at a variety of locations along the electric submersible pumping system 24. For example, the swivel 86 may be located immediately above motor connector 58 so that the motor connector 58 is able to rotate without rotating the entire electric submersible pumping system 24.

Figure 5:
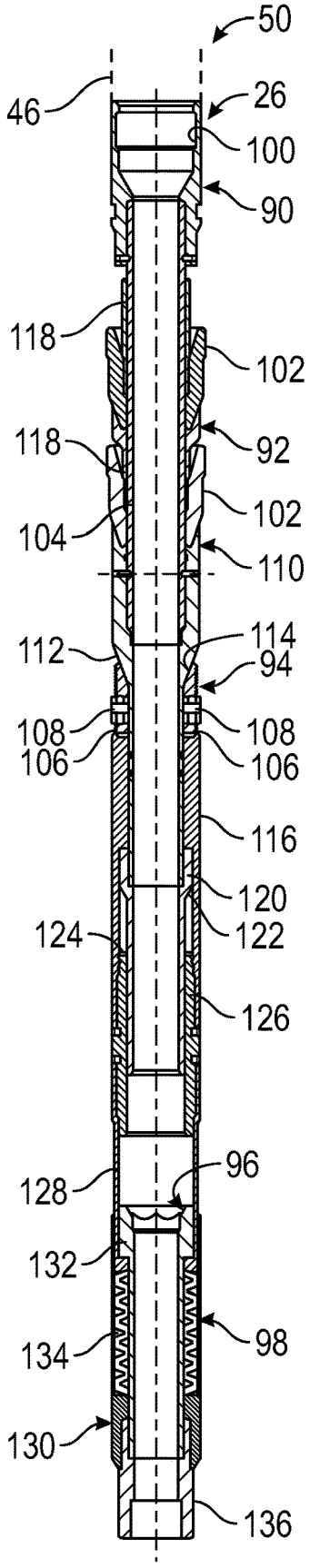
FIG. 5 is a cross-sectional illustration of an example of a spring-loaded locking sealing mechanism, according to an embodiment of the disclosure.

Referring generally to FIG. 5, an embodiment of SLLSM 26 is illustrated. In this embodiment, SLLSM 26 may comprise a head section 90, a sealing section 92, and an anchoring section 94. In some embodiments, the SLLSM 26 also may comprise an expansion joint 96 and a spring element 98. The expansion joint 96 and the spring element 98 work in combination and may be used cooperatively compensate for axial expansion or contraction of the electric submersible pumping system 24 during operation. Although various embodiments may have different configurations, the illustrated example has the sealing section 92 disposed at a lower end of the head section 90; the anchoring section 94 disposed at a lower end of the sealing section 92; and the expansion joint 96 disposed at a lower end of the anchoring section 94.

The head section 90 may comprise a profile 100 or other connection features for coupling with conveyance system 44, e.g. with running tool 46. In some embodiments, the head section 90 and/or running tool 46 may be constructed for coupling with conveyance 48 in the form of wireline, coiled tubing, rods, and/or other suitable conveyances. Additionally, sealing section 92 may comprise a sealing element 102 or a plurality of sealing elements 102 sized and arranged for sealing against an inside surface of tubing 38. In some embodiments, the sealing elements 102 may be oversized such that automatic sealing occurs upon insertion of SLLSM 26 into tubing 38. Depending on the application, the sealing elements 102 may be oriented to seal against the interior surface of docking assembly 56 or tubing/casing 38.

In some applications, the sealing elements 102 may be formed of elastomeric materials or other materials suitable for forming a secure seal against the inside surface of surrounding tubing 38. According to an embodiment, the sealing elements 102 may be formed as elastomeric cups disposed about a mandrel 104.

The anchoring section 94 also may be constructed in various configurations. In the illustrated embodiment, the anchoring section 94 comprises at least one structural feature which may be in the form of a plurality of anchors 106 having tubing engagement features 107. By way of example, the tubing engagement features 107 may comprise teeth or other suitable features oriented to engage and anchor the SLLSM 26 (and thus the electric submersible pumping system 24) against the inside surface of the surrounding tubing 38. However, the anchoring section 94 may use other types of structural features/anchors 106 to provide the desired anchoring. In some embodiments, the anchoring section 94 also may comprise anchor retraction features 108, e.g. springs, to facilitate retraction of anchors 106 from the engaged position upon release of the SLLSM 26 from the surrounding tubing 38.

In the example illustrated, the anchors 106 are mounted around a tubular portion of a wedge section 110. The wedge section 110 is connected with mandrel 104 and comprises an angular wedge region 112 positioned adjacent a corresponding angular wedge region 114 of anchors 106. To actuate anchors 106 and anchoring section 94, the mandrel 104 and wedge section 110 are moved with respect to an outer housing 116. In this example, the outer housing 116 holds the anchors 106 such that relative sliding motion may occur between the angular wedge region 112 of wedge section 110 and the corresponding angular wedge region 114 of anchors 106. This relative sliding motion forces the anchors 106 in a radially outward direction and into engagement with the interior surface of the surrounding tubing 38.

In some applications, the sealing elements 102 may be slidably mounted along mandrel 104 such that sealing element wedges 118 or other suitable elements are able to bias the sealing elements 102 outwardly into engagement with the inside surface of the surrounding tubing 38. The anchors 106 and/or sealing elements 102 may be actuated via a variety of techniques, including the use of signals sent from the surface or from another suitable location. The signals may comprise mechanical signals, hydraulic signals, and/or electrical signals depending on the construction of SLLSM 26 and the overall system.

By way of example, release of the running tool 46 may be used to mechanically set the anchoring section 94 and/or sealing section 92. In some embodiments, the running tool 46 is constructed to release upon application of a mechanical downforce, e.g. hammering, which moves the running tool 46 forcefully in a downhole direction. This mechanical, downward motion causes the wedge section 110 to move relative to outer housing 116 which may be held in place by, for example, the pumping system 20. The pumping system 20, in turn, may be held in place by, for example, docking station 60. The relative movement of wedge section 110 forces anchors 106 radially outward into anchoring engagement with tubing 38. This motion also may be used to force the sealing elements 102 radially outward via sealing element wedges 118 or other suitable features. It should be noted, however, the sealing elements 102 may be of sufficient size to automatically form a suitable seal with tubing 38 upon insertion of the SLLSM 26 into tubing 38.

The anchoring section and/or sealing section 92 also may be set via other mechanisms, e.g. hydraulic actuators, electro-mechanical actuators, pressure differentials acting on elastomeric cup-style sealing elements 102, or other suitable actuation mechanisms. In one example, the anchor section 94 may initially be set, and then the submersible pumping system 20 may be operated to establish a differential pressure above and below sealing elements 102 so as to bias the sealing elements 102 against the surrounding tubing 38.

In some embodiments, the downhole tubular portion of wedge section 110 may be coupled with a tubular component 120 having an abutment section 122. The tubular component 120 moves within outer housing 116 and abutment section 122 is oriented for potential engagement with a corresponding abutment 124 of outer housing 116 to limit the travel of wedge section 110 with respect to outer housing 116. In some applications, the corresponding abutment 124 may be part of a housing coupler 126 which connects sections of outer housing 116. For example, the housing coupler 126 may be used to engage an outer housing extension 128 which extends into engagement with expansion joint 96.

In embodiments using expansion joint 96 and spring 98, the expansion joint 96 is able to change length in an axial direction. As illustrated, the spring 98 may be a coil spring or other suitable spring positioned between an end of outer housing extension 128 and a movable portion 130 of expansion joint 96. By way of example, the movable portion 130 may comprise an inner expansion joint mandrel 132 and an outer sleeve 134. The inner expansion joint mandrel 132 and the outer sleeve 134 can move relative to outer housing extension 128 although spring 98 is oriented to resist this movement.

In other words, spring 98 is positioned to bias the SLLSM 26 to an elongated position. By way of example, the spring 98 may be selected with sufficient stiffness to maintain the expansion joint 96 in an elongated configuration during actuation of anchor section 94 while still accommodating collapse (axial contraction) of the expansion joint 96 after anchors 106 are set. In this manner, the expansion joint 96 and the spring 98 may be used cooperatively to compensate for axial expansion or contraction of the electric submersible pumping system 24 during operation of the electric submersible pumping system 24. It should be noted the expansion joint 96 is illustrated as connected with a coupling feature 136 by which the SLLSM 26 is connected to the pumping system 20, e.g. electric submersible pumping system 24. If the system does not utilize expansion joint 96, the coupling feature 136 may be connected with outer housing 116 or with other suitable components of SLLSM 26.

Figure 6:
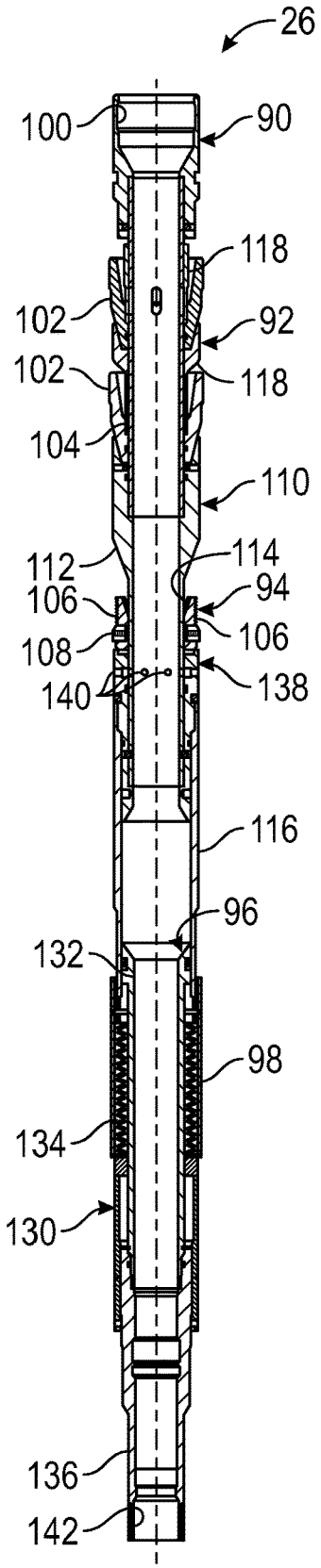
FIG. 6 is a cross-sectional illustration of another example of a spring-loaded locking sealing mechanism, according to an embodiment of the disclosure.

Referring generally to FIG. 6, another embodiment of SLLSM 26 is illustrated. In this embodiment, many of the elements are similar or the same as those referenced in the embodiment of FIG. 5 and have been labeled with common reference numerals. According to the embodiment illustrated in FIG. 6, the SLLSM 26 further comprises a bypass 138 having an opening or openings 140 which serve as a drain to allow fluid to drain from the SLLSM 26 during, for example, retrieval from borehole 22.

The bypass 138 may be positioned at various locations along SLLSM 26, and one such example is illustrated. In the illustrated example, the openings 140 are positioned laterally through the tubular portion of wedge section 110 and through a corresponding portion of outer housing 116. Prior to and/or subsequent to setting of anchoring section 94, the openings 140 in wedge section 110 and outer housing 116 are aligned to enable communication of fluid between an interior and exterior of the SLLSM 26. However, when the wedge section 110 is shifted axially with respect to outer housing 116 the openings 140 are moved out of alignment with each other to prevent communication of fluid between the interior and exterior of SLLSM 26. Appropriate seals may be used to ensure fluid flow between the interior and exterior is blocked when anchoring section 94 is set.

The bypass 138 may be used to effectively reduce pull forces experienced at the surface during withdrawal of SLLSM 26 and pumping system 20 by enabling faster drainage of fluid rather than allowing it to drain through the submersible pump 26. Generally, the bypass 138 remains open while running in hole and during retrieval of the system 50.

Referring again to FIG. 6, this embodiment also comprises coupling feature 136 connected to expansion joint 96. In this example, the coupling feature 136 comprises an inner profile 142 which may be in the form of a receiving profile constructed to receive a variety of supplemental tools. In some applications, the inner profile 142 may be a receiving profile for a tool having a lock mandrel and standing valve. Such a tool may be deployed from the surface or installed initially into this profile 142 to enable testing of various seals and tubing joints. A retrieval tool can then be used to latch into the lock mandrel so as to retrieve the tool to the surface. The inner profile 142 may be in the form of an oilfield standard internal profile for coupling with desired tools, such as the tool for testing seals.

Figure 7:
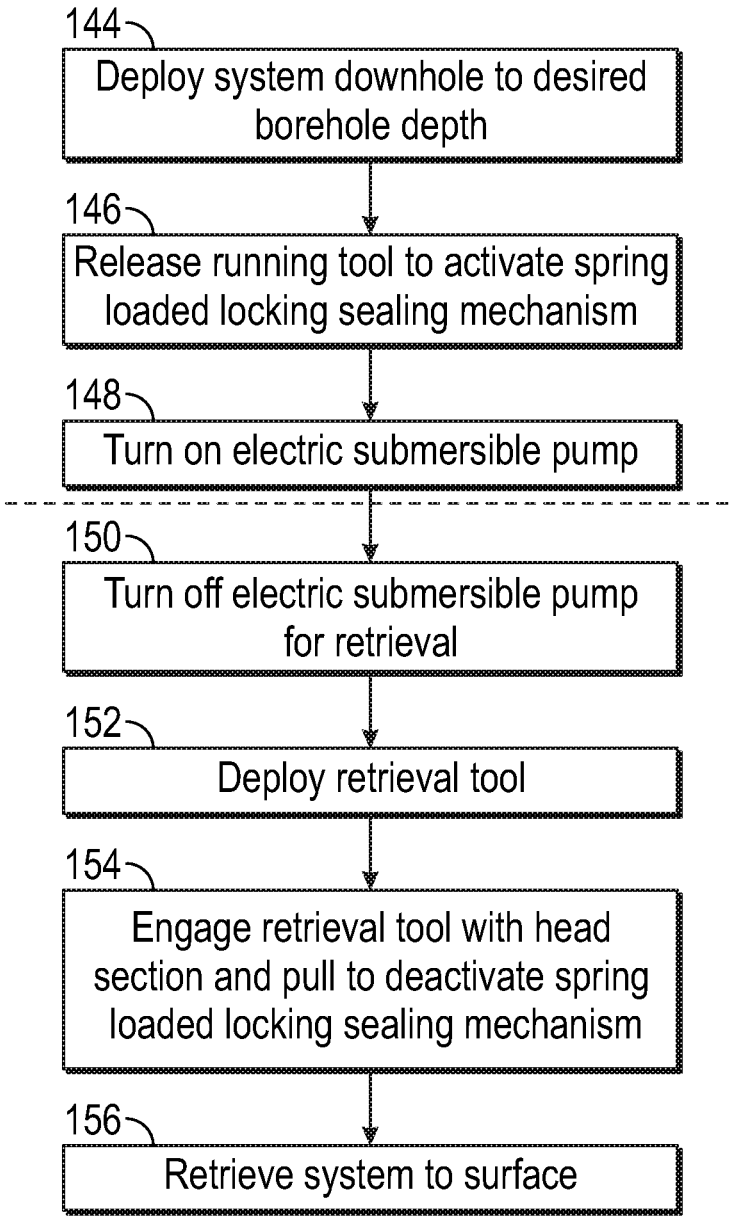
FIG. 7 is a flow chart illustrating an example of a methodology in which a submersible pumping system and spring-loaded locking sealing mechanism are deployed downhole, according to an embodiment of the disclosure.

An operational example is illustrated via the flow chart of FIG. 7. In this example, the running tool 46 is releasably connected with head section 90. The conveyance system 44 is then used to deploy the submersible pumping system 20 and SLLSM 26 into appropriately sized tubing 38 at a desired borehole depth, as indicated by flow chart block 144. The running tool 46 may then be released from the head section 90 in a manner which activates the anchoring section 94 and/or seal section 92, as indicated by block 146. As described above, the running tool 46 may be released by applying a mechanical movement, e.g. a hammering movement, to both release the running tool 46 and to set the SLLSM 26.

At this stage, the SLLSM 26 is operationally set within tubing 38, e.g. within docking assembly 56, and the pumping system 20, e.g. electric submersible pumping system 24, may be switched on to pump fluids 36 to the surface as indicated by block 148. During operation, the pumping system 20 may generate heat and experience thermal expansion resulting in axial lengthening. However, the expansion joint 96 and cooperating spring 98 accommodate the axial change, e.g. axial lengthening, of the pumping system 20 without shifting the sealing section 92 or anchoring section 94 with respect to tubing 38. Furthermore, the sealing section 92 and anchoring section 94 serve to prevent fluids produced by the pumping system 20 from recirculating back to intake 54. Also, by anchoring the SLLSM 26 with respect to tubing 38, the anchoring section 94 helps prevent hydrostatic forces from compressing the submersible pumping system 20.

If the submersible pumping system 20 and SLLSM 26 are to be retrieved, the submersible pumping system 20, e.g. electric submersible pumping system 24, is turned off as indicated by flow chart block 150. The running tool 46 or other suitable retrieval tool may be deployed downhole as indicated by block 152. The running/retrieval tool 46 may be engaged with head section 90 of SLLSM 26 and a pulling force may be applied via tool 46 and conveyance 48 so as to deactivate the SLLSM 26 as represented by block 154.

By way of example, the pulling force applied to head section 90 may be used to pull on mandrel 104 which, in turn, pulls on wedge section 110. By pulling on wedge section 110, the force applied through anchors 106 in anchoring section 94 is relieved and the retraction features/springs 108 are able to push the anchors 106 back toward the lower portion of wedge section 110 and away from the surrounding tubing 38. If the sealing elements 102 are similarly set, they also may be relaxed during the same pulling procedure to facilitate removal of the SLLSM 26. The system (e.g. electric submersible pumping system 24 and SLLSM 26) may then be retrieved to the surface as indicated by block 156.

Depending on the parameters of a given operation, the SLLSM 26 and the submersible pumping system 20 may comprise various components and configurations. For example, the SLLSM 26 may comprise various sizes and configurations of sealing elements, anchors, expansion joints, springs, and/or other supporting components. Some embodiments of SLLSM 26 may be utilized without the expansion joint and/or the sealing elements. The fluid bypass may be located in the SLLSM 26, in the submersible pumping system 20, and/or in other suitable components, e.g. see valve 88.

Additionally, the anchors 106 and/or seals 102 may be actuated via various actuators and actuation techniques. The actuation may be performed from the surface via mechanical manipulation of the conveyance system 44, as described above. For example, actuation may be performed via release of the running tool 46. Or, the actuation may be controlled from the surface via signals sent to a downhole actuator, e.g. a downhole hydraulic actuator, electro-mechanical actuator, or other suitable actuator constructed and positioned to cause the desired relative movement of components.

However, a pressure differential established by, for example, operation of submersible pumping system 20 also can be used to actuate at least one of the anchoring section and sealing section. The pressure differential acts on the sealing elements 102 or other suitable features to move the wedge section 110 with respect to the outer housing 116. This pressure differential also may be used as a supplemental technique in addition to using release of the running tool 46. In some embodiments, a catch mechanism, e.g. a ratchet or collet, may be used to capture the relative motion of wedge section 110 and outer housing 116 so as to lock the SLLSM 26 in the set configuration.

Although a few embodiments of the system and methodology have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for use in a tubing deployed in a borehole, comprising:

an electrical submersible pumping system comprising a submersible pump, a submersible electric motor, a motor protector, and an expansion joint; and a spring-loaded locking sealing mechanism coupled to the electric submersible pumping system, the spring-loaded locking sealing mechanism comprising:

a head section, the head section having an upper end to releasably receive a running tool;

a sealing section comprising at least one sealing element capable of forming a seal against an inside surface of the tubing into which the spring-loaded locking sealing mechanism is deployed;

an anchoring section comprising at least one structural feature capable of affixing the spring-loaded locking sealing mechanism within the tubing;

an expansion joint; and a spring configured to bias the spring-loaded locking sealing mechanism to an elongated position, the expansion joint of the spring-loaded locking sealing mechanism and the spring cooperatively compensating for axial expansion or contraction of the electric submersible pumping system.

2. The system as recited in claim 1, wherein the sealing section is disposed at a lower end of the head section.

3. The system as recited in claim 2, wherein the anchoring section is disposed at a lower end of the sealing section.

4. The system as recited in claim 3, wherein the expansion joint of the spring-loaded locking sealing mechanism is disposed at a lower end of the anchoring section.

5. The system as recited in claim 1, wherein the running tool is deployed on coiled tubing.

6. The system as recited in claim 1, wherein the running tool is deployed on wireline.

7. The system as recited in claim 1, wherein releasing the running tool actuates the sealing section.

8. The system as recited in claim 1, wherein releasing the running tool actuates the anchoring section.

9. The system as recited in claim 1, further comprising a docking assembly, the tubing being part of the docking assembly.

10. A system, comprising:

a spring-loaded locking sealing mechanism having:

a head section, the head section having an upper end to releasably receive a running tool;

a sealing section disposed at a lower end of the head section, the sealing section comprising at least one sealing element capable of forming a seal against an inside surface of a tubing into which the spring-loaded locking sealing mechanism is deployed;

an anchoring section disposed at a lower end of the sealing section, the anchoring section comprising at least one structural feature capable of affixing the spring-loaded locking sealing mechanism within the tubing;

an expansion joint disposed at a lower end of the anchoring section;

a spring positioned to bias the expansion joint to an elongated position; and a bypass configured to allow fluid to drain from the spring-loaded locking sealing mechanism during retrieval from a borehole.

11. The system as recited in claim 10, wherein at least one of the sealing section and the anchoring section is actuated by release of the running tool from the head section.

12. The system as recited in claim 10, further comprising a submersible pumping system coupled to the spring-loaded locking sealing mechanism, the expansion joint and the spring cooperatively compensating for axial expansion or contraction of the submersible pumping system during operation.

13. The system as recited in claim 12, wherein the submersible pumping system comprises an electric submersible pumping system.

14. A method, comprising:

running an electric submersible pumping system and a locking sealing mechanism to a desired depth in a borehole with a running tool;

maintaining a bypass of the locking sealing mechanism in an open configuration during running of the electric submersible pumping system and the locking sealing mechanism in the borehole, the bypass configured to enable fluid communication between an interior and an exterior of the locking sealing mechanism in the open configuration;

biasing the locking sealing mechanism to an elongated position with a coil spring;

releasing the running tool from the locking sealing mechanism;

actuating at least one of an anchoring section and a sealing section of the locking sealing mechanism;

moving the bypass to a closed configuration to prevent fluid communication between the interior and the exterior of the locking sealing mechanism;

operating the electric submersible pumping system; and compensating for expansion of the electric submersible pumping system via the coil spring of the locking sealing mechanism.

15. The method as recited in claim 14, wherein releasing the running tool comprises actuating both the anchoring section and the sealing section of the locking sealing mechanism.

16. The method as recited in claim 14, further comprising using an expansion joint and the coil spring of the locking sealing mechanism to cooperatively compensate for axial expansion or contraction of the electric submersible pumping system during operation.

17. The method as recited in claim 14, wherein actuating comprises actuating the anchor system to grip an inside surface of a tubing forming a portion of a docking station.

18. The method as recited in claim 14, further comprising:

returning the bypass to the open configuration; and retrieving the electric submersible pumping system and the locking sealing mechanism from the borehole.

* * * * *